United States Patent [19]

Vilain

[11] 4,127,004

[45] Nov. 28, 1978

[54] OFF-SHORE PLATFORMS AND METHODS FOR INSTALLING THE SAME

[75] Inventor: Robert H. Vilain, Maisons Alfort, France

[73] Assignee: Enterprise d'Equipements Mecaniques et Hydrauliques E.M.H., France

[21] Appl. No.: 810,190

[22] Filed: Jun. 27, 1977

[30] Foreign Application Priority Data

Jun. 30, 1976 [FR] France ..... 76 19967

[51] Int. Cl.[2] ..... E02B 17/00; E02D 27/52

[52] U.S. Cl. ..... 405/202; 405/205; 405/210

[58] Field of Search ..... 61/95, 101, 87, 89, 61/88; 114/254; 9/8 P

[56] References Cited

U.S. PATENT DOCUMENTS 3,708,985 1/1973 Pogonowski et al. ..... 61/95

3,891,037 6/1975 Well et al. ..... 61/95

FOREIGN PATENT DOCUMENTS 873,089 7/1961 United Kingdom ..... 61/101

*Primary Examiner*—Jacob Shapiro

*Attorney, Agent, or Firm*—Steinberg & Blake

[57] ABSTRACT

The invention relates to platforms of the off-shore type. It consists principally in arranging the base of the platform in the form of an elongated reservoir able to float and of a sufficient length to serve as a support for a column during transport to the anchoring point. For positioning the reservoir-base on the sea-bed, the reservoir is first of all tilted under the effect of ballasting until one of the ends of the reservoir touches the sea-bed. Then the column is released to assume its vertical position by way of floats connected thereto; and the operation is completed by ballasting to bring the reservoir-base to a horizontal position on the sea-bed.

15 Claims, 7 Drawing Figures

OFF-SHORE PLATFORMS AND METHODS FOR INSTALLING THE SAME

The present invention relates to installations comprising an off-shore platform articulated at its lower part to a base anchored on the sea-bed, the base being able to form an underwater reservoir for storing oil or other fluid (liquid or gas).

The aim of the invention is especially to increase considerably the storage capacity of the base and, at the same time, to facilitate the sea transport of the assembly as far as its place of immersion and anchoring to the sea-bed.

It consists principally in arranging the base in the form of an elongated reservoir able to float and of a sufficient length to serve as a support for the column during the transport as far as the anchoring point.

When it is a question in particular of a column connected, particularly by means of a universal joint, to its reservoir-base, the connection will be provided adjacent one of the small sides of the rectangular shaped or other shaped base so that during the sea transfer the column rests on the base in the longitudinal direction thereof. When it is immersed at the anchorage place, ballasting carried by the base is used so that this latter assumes first of all a tilted position until it comes into contact with the sea-bed after which the platform is freed so that it assumes, owing to the thrust of appropriate floats, a substantially vertical position. It only remains then to swing the base, still by means of ballasting, around its contact point with the sea-bed until it rests entirely thereon.

It is to be understood that several solutions can be envisaged for forming the reservoir-base.

It can for example be arranged in the form of a boat with walls resisting the swell.

But it can also be arranged in the form of a lighter capacity inside which sea water can have access during transport, the floatability being provided by floats inside and/or outside the wall of said base.

However that may be, after immersion and anchoring to the sea-bed (all ballast tanks being usable to provide stability), a reservoir of large capacity is obtained for storing oil, combined of course with any valve systems permitting at will the entry of water or on the contrary its expulsion by the oil to be stored, not only in the interior of the reservoir itself but also in the floats, if it has any.

The invention comprises, apart from these arrangements, certain other arrangements which are preferably used at the same time and which will be explicitly mentioned hereafter.

The invention is illustrated by way of example in the accompanying drawings, which form part of the present application.

FIGS. 1 and 2 of these drawings show respectively in side elevation and in a schematic end view, the assembly of an articulated column and its reservoir-base during sea transport to its anchoring place.

Figure 7:
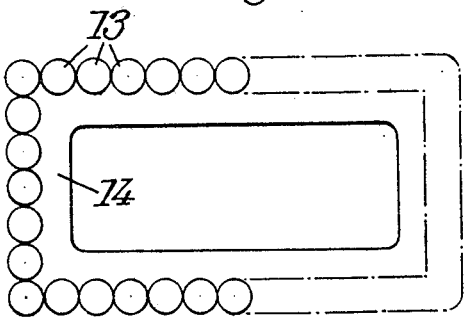

FIG. 7, finally, illustrates another embodiment of a reservoir-base conforming to the invention.

According to the invention and more especially according to that of its modes of application and those of the embodiments of its different parts to which it seems preference should be given, in order to construct and to position the assembly of an off-shore platform of the type having columns articulated by universal joints to a base, particularly for oil-fields of a depth of from 100 to 150 m, the following or similar is the procedure to adopt.

Said base is formed by a reservoir able to be used, basically, for storing oil, this reservoir being elongated and of a length of the same order of size as the length of the column so that said reservoir may be used, during sea transport, to support the column articulated thereto and resting along said reservoir.

Figure 1:
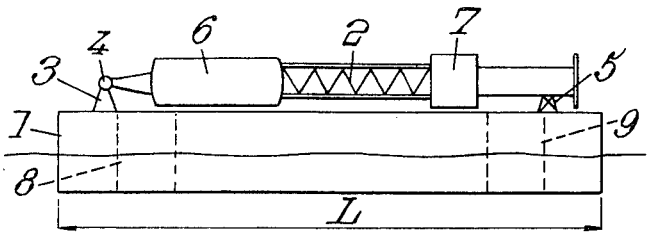
Figure 2:
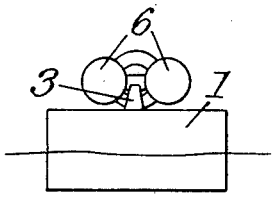

Thus, according to the schematical embodiment shown in FIGS. 1 and 2, said reservoir forming the base will be constituted by a sealed container 1 of a parallelepipedic shape whose length L will be selected slightly larger than the immersion height at the anchoring place on the sea-bed.

This length L is then sufficient for column 2 to rest on the upper surface of the reservoir, while being supported at its base by a support 3 disposed adjacent one of the small ends of the parallelepiped, the universal joint 4 being positioned at the outset, whereas it rests at its other end on another temporary support such as 5. It will be seen that the platform is equipped with reservoirs forming floats (and possibly ballasting) such as 6 and 7. Moreover, it will be noted that the support 3 is in the form of a pedestal carried by the top surface of the base-reservoir 1 and extending upwardly to an elevation higher than the highest elevation of the top surface of the base-reservoir 1, with the universal joint 4 being situated at the top end of the pedestal 3, so that in this way this universal joint 4 is situated at an elevation higher than the highest elevation of the top surface of the base-reservoir 1. In this way it is possible without diminishing the volume in the interior of the base-reservoir 1 and without complicating the structure thereof to accommodate the column 2 in the manner shown in FIG. 1 extending along the upper portion of the base-reservoir 1.

The base-reservoir 1 is fitted at its ends with ballasting devices 8 and 9, to be used for the immersion as outlined further on.

As far as the formation of the reservoir is concerned, which is to serve as a means of sea transport between the construction yard on land and the drilling or storing location, different procedures can be adopted.

First of all, as seen in FIGS. 1 and 2, this reservoir (whose length may be of the order of 100 to 150 m or more) may be arranged in the manner of a boat, made water tight in its upper part. This solution, which can be perfectly well considered, requires a fairly heavy construction since the walls of the boat must be able to resist the swell.

Figure 5:
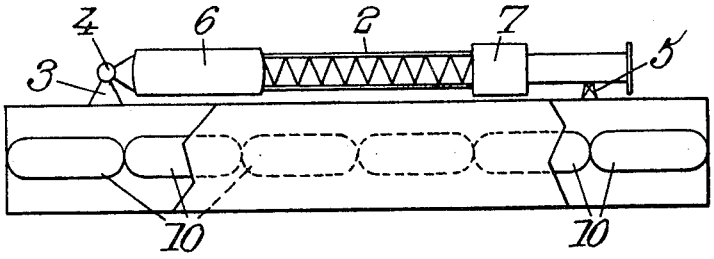
FIGS. 5 and 6 illustrate such an assembly in the transport position according to another embodiment.
Figure 6:
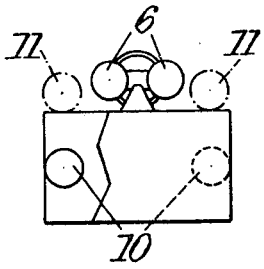

Another solution consists in providing the floatability of the reservoir, not by itself, but by means of appropriate floats contrived either in the reservoir, as shown at 10 in FIGS. 5 and 6, or above, as shown at 11 in FIG. 6, these different methods being usable together.

This second solution is more advantageous since the walls of the reservoir will practically not have to withstand the swell, if care is taken to let the sea level establish itself, by means of inlets combined of course with valves, inside the reservoir, in which case the floats, formed for example by cylinders 10 and/or 11, must be calculated to support the apparent weight of the assembly. In this case, the structure of the reservoir can be much lighter.

Cylinders 10, 11, as well as ballasting devices 8,9 will be combined with valve and pump systems for emptying them or filling them with water at will.

A third solution is shown in FIG. 7, where the structure of the reservoir is formed by assembling, for example by welding, longitudinal tubes 13 in combination with transverse frames 14. Here again, the sea level can be allowed to establish itself inside the container thus formed (through appropriate valves, as in the preceding case), so as to neutralize the effect of the swell, the floatability being obtained by tubes 13 emptied or filled at will.

Other embodiments are of course possible.

In any case, whatever the embodiment adopted, the transport and the immersion take place in the following way.

FIGS. 1 and 2 show the assembly of the reservoir and the column lying along the upper wall thereof. It is in this form that said assembly, floating with shallow draught, is brought from the construction yard to the place of immersion by individual motor or by tug.

Ballast tanks 8 and 9 are empty or partially empty. The same goes for float cylinder when such floats are used. In this case (FIGS. 5 to 7) the sea water is allowed to penetrate through valves or suitably controlled inlets into the inside of the reservoir.

For the immersion and as a first operation a first lowering of the assembly is undertaken by partially filling some of ballast tanks 8, 9 while still providing of course, by means of these ballast tanks, the transverse stability.

Then, in a second operation, ballast tanks 8 disposed on the same side as the universal joint 4 are filled, which causes the reservoir to sink with the platform.

With this operation, the lower end of the reservoir adjacent the foot of the column sinks until it comes into contact with sea-bed 15 (FIG. 3), whereas the other end continues to float. During this movement, the transverse stability is maintained by the non-filled upper ballast tank(s) 9 or the nonfilled cylindrical floats (FIGS. 5 to 7), and also by the main float 6 of the column when it is immersed.

Figure 4:
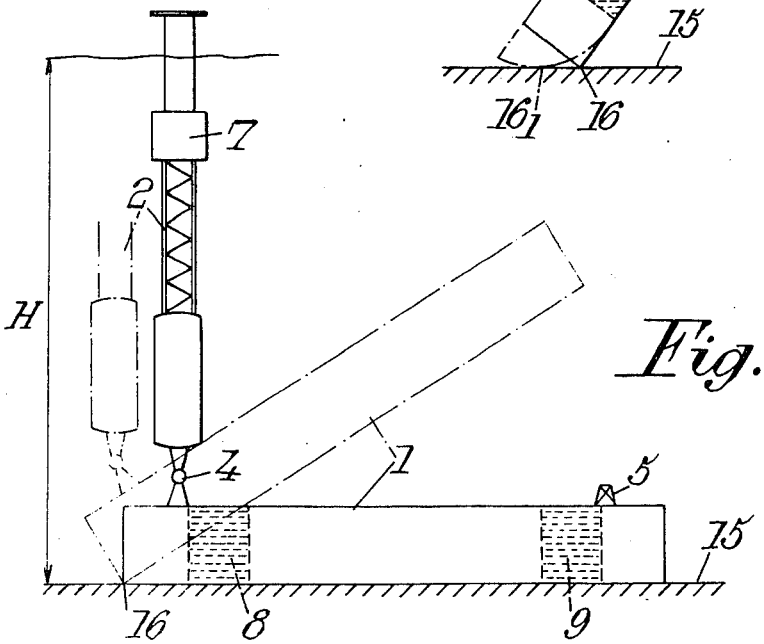

In a third operation, the temporary fastening between the top part of the column and the reservoir at 5 is released and the column stands up straight again until it assumes a vertical position (or almost), under the effect of its floats 7; it is then secured to the reservoir only by the universal joint hinge at its foot and can sway freely (FIG. 4).

In a fourth operation, the ballast tank(s) 9 of the reservoir located on the side opposite the foot of the column are filled. The reservoir then pivots about lower edge 16 (FIGS. 3 and 4) which is in contact with the sea bottom. It is the support given by this edge on the bottom over the whole width of the reservoir which provides the transverse stability of the assembly during this time and avoids any lateral tilting thereof. The movement can thus be continued until the reservoir rests entirely on the bottom. The articulated production column has then assumed its normal position (FIG. 4).

Figure 3:
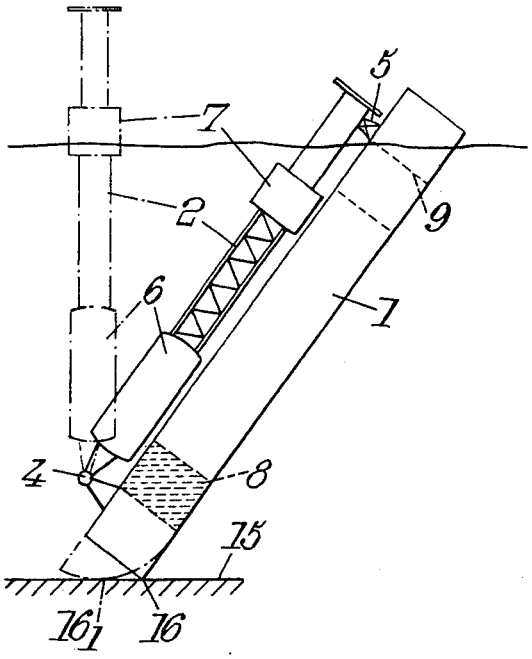
FIGS. 3 and 4 illustrate in elevation the different operations for placing the assembly on a sea-bed.

It will be noted that, according to an advantageous embodiment shown in dotted lines at $16_1$ in FIG. 3, the lower end region of the reservoir-base is given a rounded shape, practice and calculation showing that this arrangement increases the stability during rocking.

With the reservoir thus positioned on the sea-bed it is to be noted that at that time the reservoir and its floats are full of water. Furthermore, in order to ensure an efficient anchorage, it is advantageous to fill at least some of the compartments of the reservoir or ballast tanks with a sand, concrete or baryta ballast whereas all the other compartments, floats or inner spaces, at present filled with water, will be available later to receive oil for storage.

For this storage a system of pumps and valves is provided suitable for introducing the oil while blowing out the water in front of it.

In particular, this assembly will be connected to a production platform disposed at a distance and connected thereto by a pipeline. The column 2 itself can be designed as a loading column, allowing boats to come alongside.

Following which, whatever the embodiment adopted, an installation may be obtained whose operation is sufficiently clear from what has gone before and which presents, in relation to installations of the kind in question already existing, numerous advantages, particularly:

the possbility of simplifying to the maximum the operations of positioning the platform and its base, the possibility, taking into account the large size of the base whose length is of the same order of size as the depth of the working site, of providing a storage reservoir of large dimensions, and the possibility however of providing sea transport in all safety, with a relatively light floating assembly, particularly in those embodiments in which water is allowed to penetrate inside the floating reservoir during transport, the floatability being provided by floats.

As is evident and from what has gone before, the invention is in no wise limited to those of its modes of application and embodiments which have been more especially considered; it covers on the contrary all variations thereof.

Thus, the elongated base means 1 which is capable of serving as a storage reservoir as well as a floating transporting vessel, has the illustrated elongated configuration providing this base means 1 with a length which is at least on the order of, although actually somewhat longer than, the depth of the sea at the location where the base means is to be anchored to the sea bed, this base means 1 fixedly carrying at its upper surface adjacent one end region thereof the connecting means 3, 4 which serves to connect to the base means 1 the elongated column 2 in a manner articulating the column 2 to the base means 1 for free movement in all directions with respect thereto with the column means 2 being capable of extending along the upper surface of the base means 1 throughout the full length which the column means 2 has in its finally installed condition where the column means 2 will have an upper end region situated above the surface of the sea. The column means 2 is releasably connected with the base means 1 at an end region of the latter distant from the end region where the connecting means 3, 4 is located by way of a releasable connecting means 5 so that when, due to operation of the ballast means 8, which is carried by the base means 1, the structure has the condition indicated in solid lines in FIG. 3, the releasable connecting means 5 can be operated to release the column means 2 from the base means 1, so that the float means 6, 7 operatively connected to and carried by the column means 2 will then be operative to cause the column means 2 to assume its upright condition indicated in dot-dash lines in FIG. 3. Thereafter the ballast means 9 which is situated at an opposite end region of the base means 1 from the ballast means 8 can be operated to cause the base means to assume the position indicated in FIG. 4, so that the base means 1 first turns downwardly in one direction to assume the position shown in solid lines in FIG. 3 and then turns downwardly in an opposite direction to assume the position shown in solid lines in FIG. 4.

I claim:

1. A reservoir and articulated column assembly comprising elongated hollow base means for assuming a floating condition acting as a transporting vessel as well as for assuming a submerged condition resting on a sea bed and serving as a storage reservoir, said elongated base means having a length which is at least on the order of the depth of the sea at the location where the base means is submerged to rest on the sea bed, elongated column means having a length which is at least almost as great as the length of said base means, said elongated column means having opposed bottom and top ends, and connecting means fixedly carried by said base means at an upper surface thereof and adjacent one end region thereof, said connecting means being connected to said bottom end of said column means for providing an articulated connection of said column means at said bottom end thereof to said base means according to which said column means is movable in all directions at said articulated connection with respect to said base means, so that said column means while connected by said connecting means to said base means is capable of extending horizontally along the upper surface of said base means with the top end of said column means situated adjacent an end region of said base means which is opposed to said one end region thereof while said base means assumes said floating condition acting as a vessel for travelling to the location where said base means is to be submerged while transporting said column means to the latter location, float means carried by said column means for causing the latter automatically to assume an upright condition when the base means is submerged to engage the sea bed with said column means when in said upright condition having its top end situated above the surface of the sea, so that upon submerging of the base means to the sea bed at said location said column means will assume its upright condition with its top end situated above the surface of the sea without changing the length of said column means, and ballast means carried by and operatively connected to said base means for controlling the submerging thereof.

2. The assembly of claim 1 and wherein a releasable connecting means releasably connects said column means to said base means at a location distant from said one end region thereof for maintaining said columnn means in a position extending along the upper surface of said base means while the latter assumes its floating condition as a transporting vessel and also during at least part of the submerging of said base means, said releasable connecting means being operable to release said column means for movement to its upright position extending upwardly from said one end region of said base means.

3. The assembly of claim 2 and wherein said releasable connecting means is situated adjacent said top end of said column means when releasably connecting said column means to said base means.

4. The assembly of claim 1 and wherein said ballast means includes a pair of ballast portions respectively situated adjacent the opposed end regions of said base means and capable of being independently operated for controlling the submerging of said base means.

5. An assembly as recited in claim 4 and wherein said portion of said ballast means adjacent said one end region of said base means is operatively connected thereto for first submerging said one end region of said base means until said one end region engages the sea bed.

6. An assembly as recited in claim 5 and wherein said one end region of said base means has a lower convexly curved surface for engaging the sea bed to provide for rocking movement of said base means with respect to the sea bed at said one end region of said base means.

7. An assembly as recited in claim 1 and wherein said elongated base means has a streamlined configuration similar to that of a boat.

8. An assembly as recited in claim 1 and wherein said base means includes hollow float means for controlling the floating and submerging of said base means.

9. An assembly as recited in claim 1 and wherein said base means is in the form of a plurality of elongated tubular members fixed to each other and forming an outer hull for said base means.

10. An assembly as recited in claim 1 and wherein said connecting means includes a pedestal fixedly carried by said base means at said one end region thereof and extending upwardly therefrom to an elevation higher than any part of said upper surface of said base means, said connecting means including a universal joint carried by an upper end of said pedestal and connecting said bottom end of said column means to said pedestal.

11. An assembly as recited in claim 10 and wherein the elevation of said universal joint is sufficiently above the highest part of said upper surface of said base means to provide for situating said column means horizontally along the upper surface of said base means in a condition where said column means in its entirety is situated at an elevation no lower than the uppermost part of the upper surface of said base means.

12. A method for installing at an off-shore location an assembly which includes an elongated base means the length of which is on the order of the depth of the sea at the latter location and an elongated column means articulated to the base means at one end region thereof, comprising the steps of initially placing said base means in a floating condition and transporting the column means connected to the base means to said off-shore location while said base means is in said floating condition and travels, while floating on the sea, to said off-shore location, said column means carrying float means for causing the column means to assume an upright condition upon submerging of the base means, and submerging said base means onto the sea bed at said off-shore location while said float means provides for said column means an upright attitude extending upwardly from said one end region of said base means when the latter has been submerged, said column means having a length sufficiently great for a top end thereof to be situated above the surface of the sea when said base means is submerged.

13. A method as recited in claim 12 and including the step of maintaining the column means releasably connected with the base means during at least part of the submerging thereof, and then releasing the column means after the base means has been partially submerged so that the float means will then cause the column means to assume its upright attitude while the submerging of the base means to the sea bed is completed.

14. A method as recited in claim 13 and including the step of first submerging to the sea bed that end region of said base means to which the bottom end of the column means is articulated, and then submerging the opposite end region of the base means to the sea bed, so that the base means tilts first in one direction and then in an opposite direction while being submerged.

15. A method as recited in claim 14 and including the step of releasing the column means to assume its upright attitude after submerging to the sea bed that end region of the base means to which the bottom end of the column means is articulated, and thereafter submerging the opposite end of the base means to the sea bed.

* * * * *